US005765534A

United States Patent [19]

Brown et al.

[11] Patent Number: 5,765,534

[45] Date of Patent: Jun. 16, 1998

[54] LOADING ABSORBING JUMPER TUBE ASSEMBLY

[75] Inventors: Peter A. Brown, Dunlap; Keith E. Lawrence, Peoria; Richard A. Linse, Metamora; William E. Moser, Peoria, all of Ill.

[73] Assignee: Caterpillar Inc., Peoria, Ill.

[21] Appl. No.: 853,818

[22] Filed: May 9, 1997

Related U.S. Application Data

[60] Provisional application No. 60/033,119 Dec. 10, 1996.

[51] Int. Cl. [6] ..... F02M 27/04

[52] U.S. Cl. ..... 123/470; 123/509

[58] Field of Search ..... 123/509, 470, 123/468, 469, 446, 456, 495

[56] References Cited

U.S. PATENT DOCUMENTS

| | | | |
|---|---|---|---|
| 4,665,876 | 5/1987 | Hashimoto | 123/469 |
| 4,881,763 | 11/1989 | Guido | 123/469 |
| 5,033,435 | 7/1991 | Ostarello | 123/469 |
| 5,365,907 | 11/1994 | Dietrich | 123/470 |
| 5,499,612 | 3/1996 | Haughney et al. | 123/470 |
| 5,520,155 | 5/1996 | Hefler | 123/509 |
| 5,566,658 | 10/1996 | Edwards | 123/470 |

*Primary Examiner*—Carl S. Miller
*Attorney, Agent, or Firm*—Alan J. Hickman

[57] ABSTRACT

A jumper tube assembly connects a fluid supplying port of a fluid passing member to an inlet port of a fuel injector and passes fluid flow between the fluid supplying port and the inlet port. A tubular conduit of the jumper tube assembly is connected at a first end portion by brazing to a sealing member has a configuration sufficient to absorb a fluid applied load and provide a leak resistant joint at the inlet port to the fuel injector. The jumper tube assembly is particularly suited for use in a fuel injection system of an internal combustion engine.

10 Claims, 4 Drawing Sheets

112
110
114
114
28
88
104
98
32
86
106
16
18
108
80
80
10
76
30
44
60
42
35
40
34
38
12
14

LOADING ABSORBING JUMPER TUBE ASSEMBLY

CROSS REFERENCE TO RELATED APPLICATIONS

This application is based, in part, on the material disclosed in U.S. provisional patent application Ser. No. 60/033119 filed Dec. 10, 1996.

TECHNICAL FIELD

This invention relates to a fluid passing jumper tube assembly for connecting a fluid passing member to a fuel injector of an internal combustion engine and more particularly to a fluid passing jumper tube assembly having a sealing member capable of absorbing high static assembly and dynamic loads.

BACKGROUND ART

Hydraulically actuated fuel injection system have been in use for some time. In such fuel injection systems, for example, as shown in U.S. Pat. No. 5,499,612, dated Mar. 19, 1996, to Michael A. Haughney et al., the actuating fluid is often communicated to the actuating fluid inlet port(s) of each injector by a respective jumper tube assembly connected between a common rail passage of the internal combustion engine and each of the fuel injectors.

It has been found that in some applications abrupt stopping of the high velocity fluid in the jumper tubes generates large hydraulic pressure waves and high hydraulic momentum forces, muck like water hammer. This occurs when fuel injection is rapidly cut off. This hydraulic hammer is normally insignificant and of no consequence. However, at near rated engine conditions and with the fluid heated, the acoustic frequency of the fluid changes. This change in frequency can overlap with the natural frequency of the mechanical system, including the jumper tube assembly, which excites the jumper tube assembly to resonate. As a result, high fatigue stress and cracks in the tube can occur with a conventional 37 degree flare tube at the outer edge of the flared flange in the fillet radius if the resonance is not damped out properly. This results in failure of the jumper tube assembly and undesirable and unplanned down time of the engine.

The present invention is directed to build more robustness into the jumper tube and allow it to handle high assembly and dynamic forces.

DISCLOSURE OF THE INVENTION

A load absorbing jumper tube assembly for connecting an inlet port of a fuel injector to a fluid supplying port of a fluid passing member of an internal combustion engine and passing fluid flow between the fluid passing member and the fuel injector is provided. The load absorbing jumper tube assembly includes a tubular conduit having a first end portion, a second end portion and is configured to position the first end portion adjacent the fuel injector inlet port and the second end portion adjacent the fluid passing member fluid supplying port. A seat having a spherical surface extends from the fuel injector adjacent the inlet port. A sealing member has first and second opposite ends, a seat engaging surface at the first end, a counterbore disposed in and opening at the second end of the sealing member, and a bore disposed in the sealing member, opening at the seat engaging surface and opening into the counterbore. The counterbore and bore are coaxial and define a step surface.

The tubular conduit first end portion is disposed in the counterbore, engaged with the step surface and connected to the sealing member. A clamping flange has a central aperture and is loosely disposed about the tubular conduit. The clamping flange is engageable with the sealing member and adapted to forcibly urge the seat engaging surface of the sealing member into sealing contacting engagement with the conical surface of the seat. This construction stiffens the natural frequency of the mechanical system and provides additional strength to the resist the forces applied.

The sealing member includes a neck having a longitudinal axis, a cylindrical portion adjacent the second end of the sealing member and a tapered portion of increasing diameter located between the cylindrical portion and the second end. The neck has a predetermined length and the counterbore is axially disposed in the neck and extends into the sealing member a predetermined distance greater than the length of the neck. This construction provides additional strength to the jumper tube assembly and assists in absorbing the loads applied.

BEST MODE FOR CARRYING OUT THE INVENTION

Figure 1:
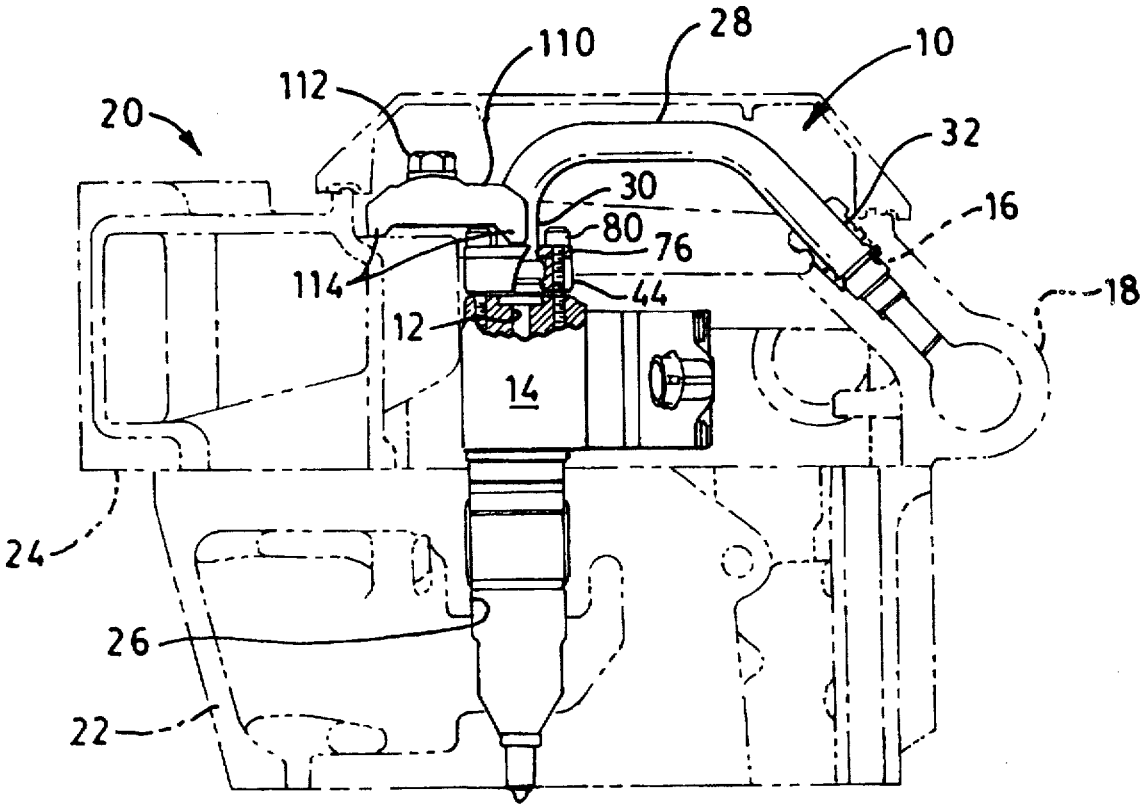
FIG. 1, is a partial diagrammatic view of an embodiment of the present invention showing a load absorbing jumper tube assembly connecting an inlet port of a fuel injector to a fluid supplying port of a fluid passing member of an internal combustion engine.

With reference to the drawings and particularly FIG. 1, a load absorbing jumper tube assembly 10 is shown connecting an inlet port 12 of a fuel injector 14, for example a hydraulically actuated electronically controlled unit pump injector, to a fluid supplying port 16 of a fluid passing member 18, for example a common fluid manifold, of an internal combustion engine 20. The jumper tube assembly 10 passes fluid flow between the fluid passing member 18 and the fuel injector 14. The internal combustion engine 20 has at least one cylinder head 22, an air intake manifold 24 or valve cover base. The fuel injector 14 is disposed in a bore 26 in the cylinder head 22. In multiple cylinder engines, a fuel injector is associated with each cylinder and a jumper tube assembly 10 connects the fluid passing member 18 to each of the fuel injectors 14.

A tubular conduit 28 having first and second spaced end portions 30,32 is configured to position the first end portion 30 adjacent the fuel injector inlet port 12 and the second end portion adjacent the fluid supplying port 16 of the fluid passing member 18. In particular, the tubular conduit 28 is bent to substantially axially align the first and second end portions 30,32, respectively, with the inlet port 12 and the fluid supplying port 16 so that easy connection of the jumper tube assembly 10 may be made.

Figure 2:
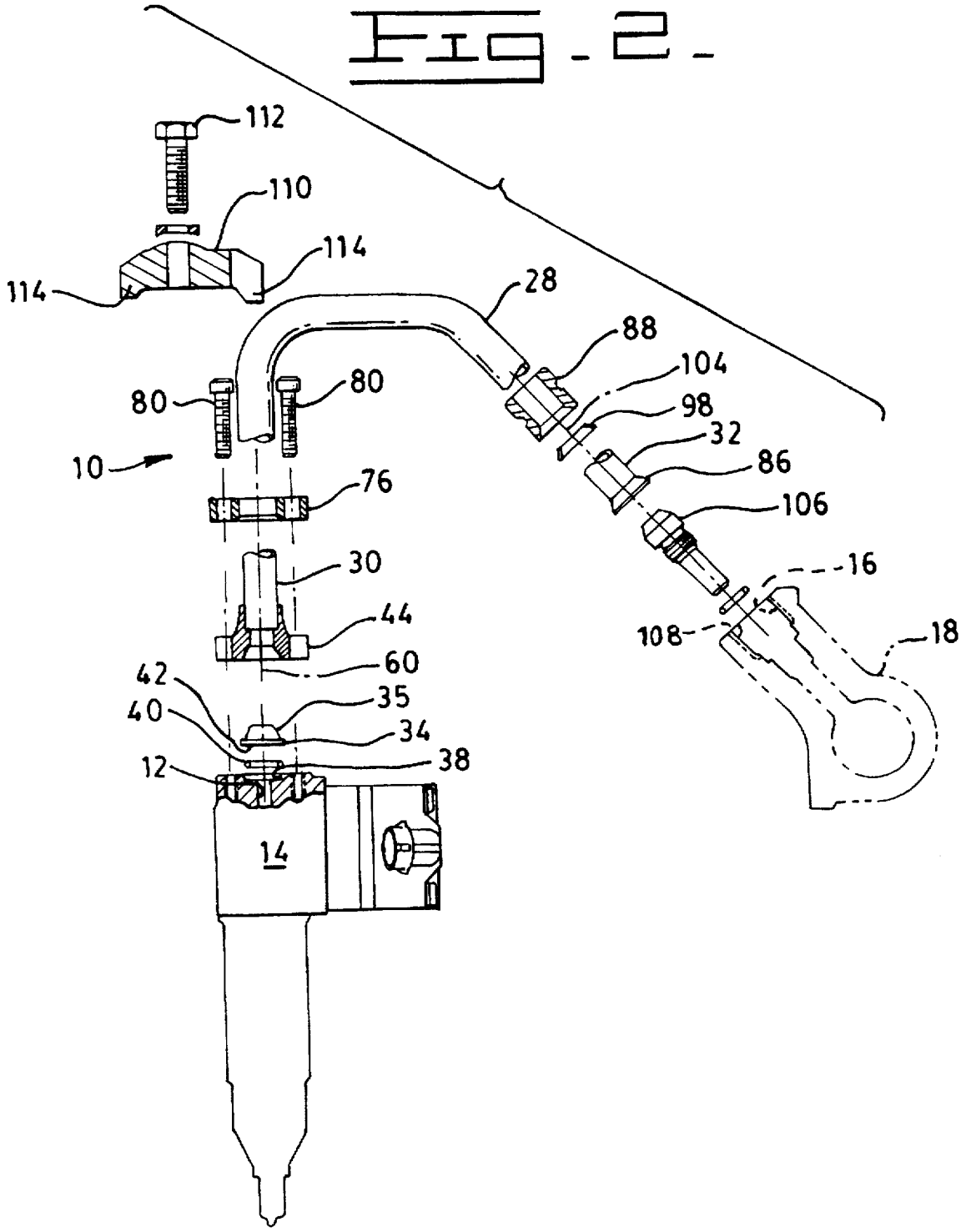
FIG. 2, is a diagrammatic exploded view of the load absorbing jumper tube assembly of FIG. 1.
Figure 3:
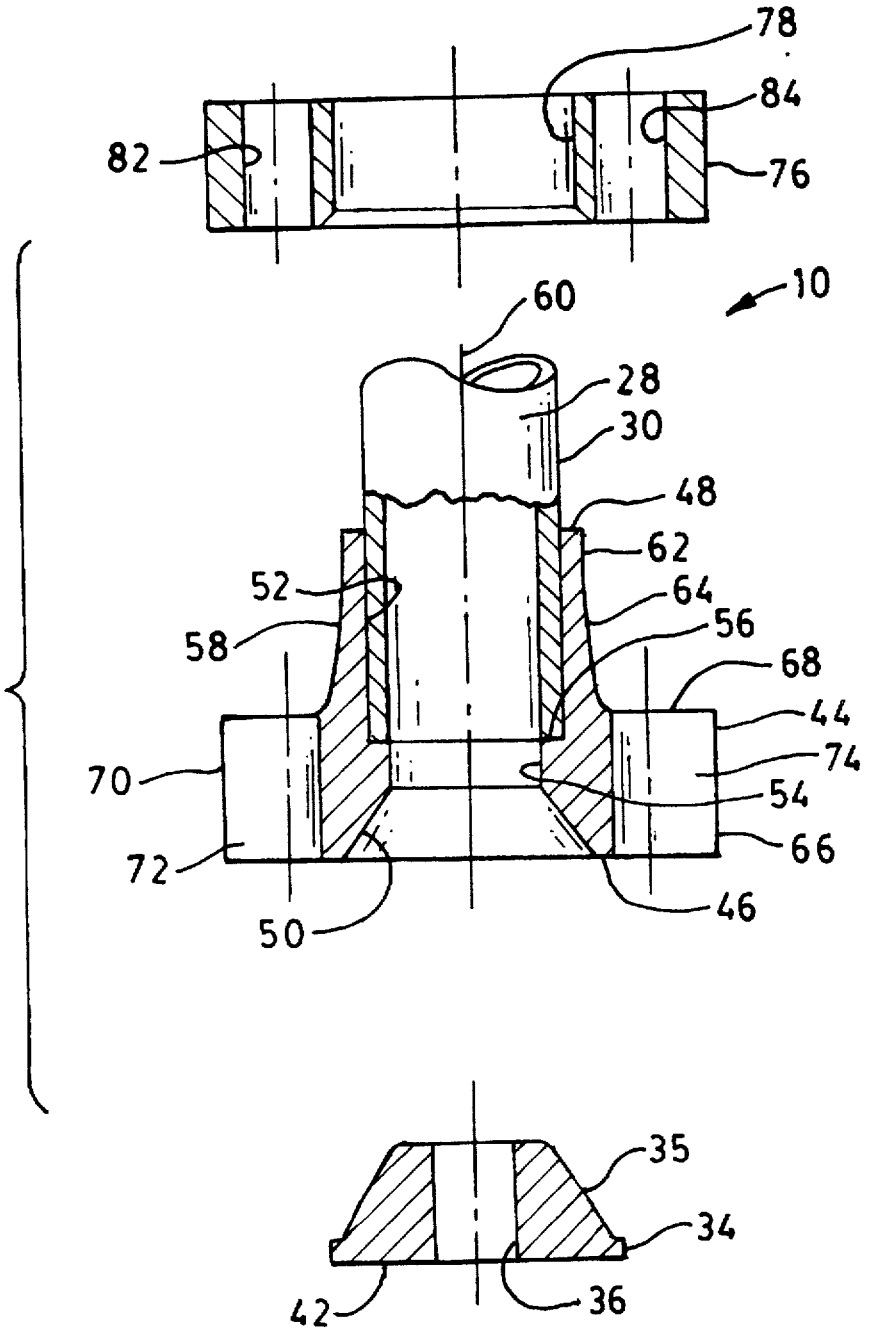
FIG. 3, is an enlarged diagrammatic detailed view of a portion of the load absorbing jumper tube assembly of FIG. 2 showing the exploded elements of one end portion in greater detail.

As best seen in FIGS. 2 and 3, a seat 34 having a spherical surface 35 is positioned to extend from the fuel injector 14 adjacent the inlet port 12 of the fuel injector 14. The seat 34 is disposed concentrically about the inlet port 12 and passes fluid flow through a central aperture 36 disposed therein. The fuel injector 14 has a groove 38 or counterbore for receiving a seal 40 therein. The groove is positioned about the opening of the inlet port 12 of the fuel injector 14. This seal 40 engages a side 42 of the seat 34 and seals fluid from leaking between the seat 34 and the fuel injector 14. Alternatively, the seat 34 may be connected to or formed as part of the fuel injector 14 in a conventional manner and thereby eliminating the need for seal 40.

A sealing member 44 has first and second opposite ends 46,48 and a seat engaging surface 50 opening at the first end 46. The seat engaging surface 50 is preferably conical. A counterbore 52 is disposed in the sealing member 44 and opens at the second end 48. A bore 54 is disposed in the sealing member 44 and opens at the seat engaging surface 50 and into the counterbore 52. The counterbore 52 and bore 54 are coaxial and define a step surface 56 therebetween. The first end portion 30 of the tubular conduit 28 is disposed in the counterbore 52 and engaged with the step surface 56. The first end portion 30 is connected to the sealing member 44 by brazing using a suitable brazing material capable of withstanding the operating temperature and fluid applied loads.

The sealing member 44 has a longitudinal axis 60 and a neck 58 disposed about the longitudinal axis 60. The neck 58 has a cylindrical portion 62 adjacent the second end 48 of the sealing member 44 and a tapered portion 64 of increasing diameter located between the cylindrical portion 62 and the second end 48. The neck 58 has a predetermined length and said counterbore 52 being axially disposed in the neck 58 and extending into the sealing member 44 a predetermined distance greater than the length of the neck 58. The sealing member 44 has a radially extending flange portion 66. The radially extending flange portion 66 has a surface 68 and the tapered portion 64 of the neck 58 terminates at the surface 68 of the flange portion 66. The tapered portion 64 has a maximum crossectional diameter at a junction of termination of the neck 58 at the surface 68 of the flange portion 66 and a minimum crossectional diameter at a junction of intersection between the cylindrical portion 62 and the tapered portion 64. The tapered portion 64 increases the strength of the neck 58 and eliminates stress risers so that cracking and premature failure of the sealing member 44 is prevented.

The step surface 56 of the counterbore 52 is located axially between the first end 46 of the sealing member 44 and the surface 68 of the flange portion 66. Having the step surface 68 at such a location increases the strength of the sealing member 44 and reduces the potential for cracks to develop in the sealing member 44. The counterbore 52 being axially disposed a distance greater than the full length of the neck 58 into the flange portion 66 provides adequate braze length for the first end portion 30 of the tubular conduit 28 and improved strength.

The radially extending flange 66 of the sealing member 44 has a side 70 oriented transverse to the surface 68. First and second spaced slots 72,74 are disposed through the radially extending flange in the direction of the axis 60. The slots 72,74 open at the side 70, the first end 46 and the surface 68 of the flange 66.

A clamping flange 76 has a central through aperture 78 and is loosely disposed about the tubular conduit 28. The clamping flange 76 is engageable with the sealing member 44 and particularly with the surface 66. The clamping flange 76 is adapted to forcibly urge the conical seat engaging surface 50 of the sealing member 44 into sealing contacting engagement with the spherical surface 35 of the seat 34. The spherical and conical shapes provide a tight leak free joint when a clamping force is applied.

A plurality of threaded fasteners 80 are screw threadably connected to the fuel injector 14 and freely disposed in the first and second slots 72,74. The clamping flange 76 has first and second spaced through apertures 82,84. The central aperture 78 is located between the first and second apertures 82,84 and the first and second apertures 82,84 are spaced to be aligned with the first and second slots 72,74, respectively. The threaded fasteners 80 being disposed in the apertures 82,84 and forcing the clamping flange 76 into engagement with the surface 68 of the radially extending flange portion 66.

Figure 4:
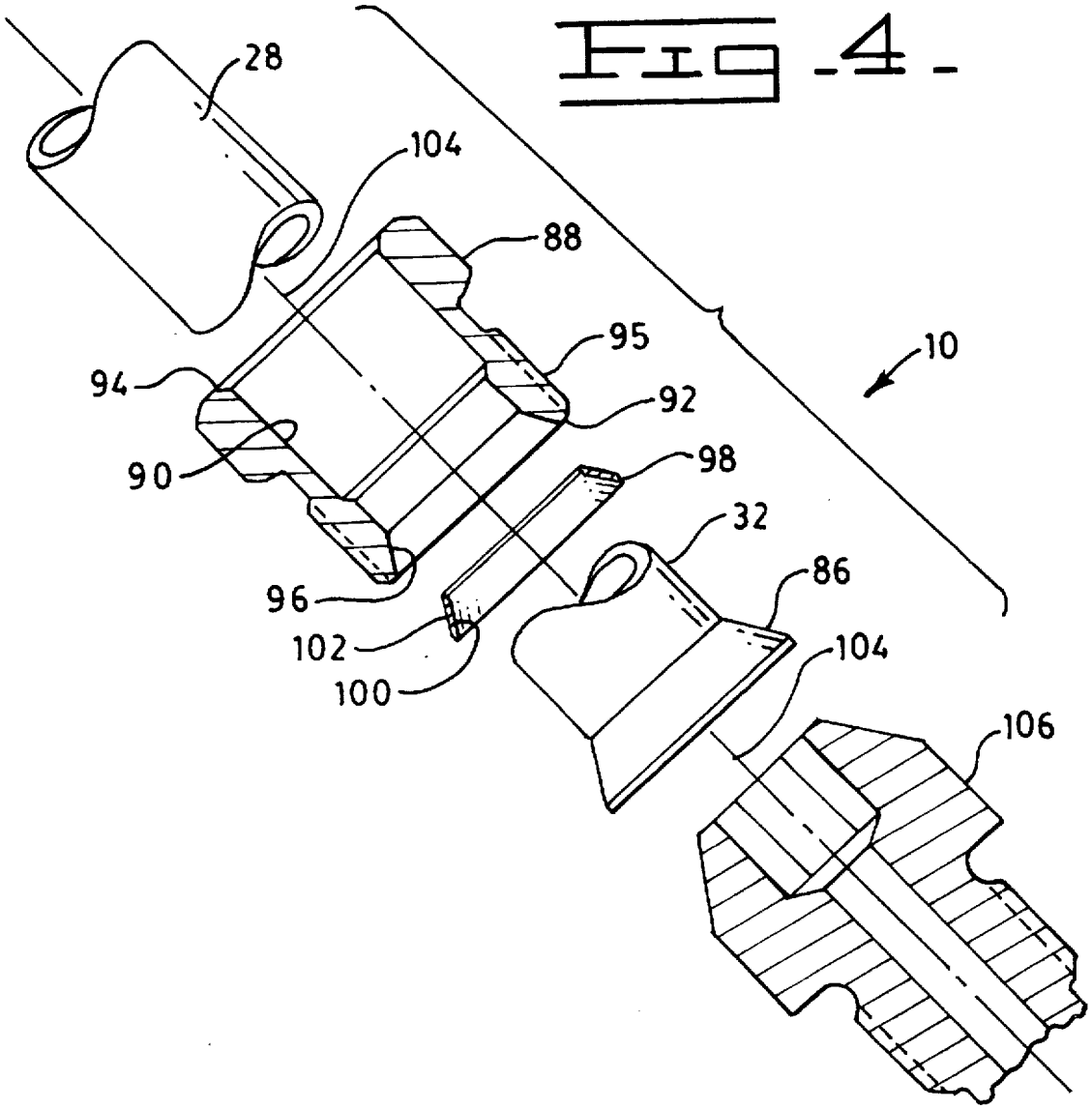
FIG. 4, is an enlarged diagrammatic detailed view of a portion the load absorbing jumper tube assembly of FIG. 2 showing the exploded elements of the other end portion in greater detail.

As best seen in FIGS. 2 and 4, the second end portion 32 of the tubular conduit has a flared end portion 86. A fitting member 88 having a bore 90 disposed axially therethrough has first and second spaced ends 92,94 and a threaded cylindrical outer portion 95. The fitting member 88 has a conical surface 96 at the first end 92 of the fitting member 88. The fitting member bore 90 is open at the conical surface 96 and open at the second end 94 of the fitting member 88. The tubular conduit second end portion 32 is disposed in the bore 90 of the fitting member 88.

A sleeve member 98 having first and second conical surfaces 100,102 is disposed about the second end portion 32 of the tubular conduit 28 at a location between the flared end portion 86 of the tubular conduit 28 and the conical surface 96 of the fitting member 88. The first and second conical surfaces 100,102 are at a common angle to a central axis 104 and are substantially equal in magnitude to an angle of the flared end portion 86 and the conical surface 96 of the fitting member 88 relative to the central axis 104.

A fluid passing member seat 106 is connected to the fluid passing member 18 and disposed in the fluid supplying port 16. The fluid passing member has a threaded portion 108 disposed in the fluid supplying port 16. The fitting member 88 outer threaded portion 95 is screwthreadably connected to the threaded portion 108 of the fluid supplying port 16. The sleeve member 98 is forcibly urged by the fitting member 88 into engagement with the conical surface 96 of the fitting member 88 and into forcible engagement with the flared end portion 86 of the tubular conduit 28. The flared end portion 86 of the tubular conduit 28 is urged by the fitting member 88 into forcible engagement with the fluid passing member seat 106. This construction provides a tight leak resistant connection between the jumper tube assembly 10 and the fluid passing member 18 under high loads.

As shown in FIGS. 1 and 2, a clamp 110 is connected to the intake manifold 24 of the engine 20 by a bolt 112. The clamp has a plurality of spaced fingers 114, engaged with the manifold 24 and the clamping flange 76. The bolt is disposed in an aperture in the clamp 110 between the spaced fingers 114. The clamp 110, straddles the tubular conduit 28 and engages the clamping flange 76. The force applied by the bolt 112, urges clamping flange 76 and the fuel injector in a direction toward the bore 26 and retains the fuel injector 14 in place in the bore 26.

INDUSTRIAL APPLICABILITY

With reference to the drawings, and in operation, the jumper tube assembly 10 is capable of absorbing the fluid related forces of the fluid supplied to the fuel injector(s) 14 and the clamp 114 assembly loads without damage to the jumper tube assembly 10. Further, the mechanical resonance of the jumper tube assembly 10 is increased which decreases the dynamic loading on the tube.

The sealing member 44 of the jumper tube assembly 10 raises the natural frequency of the mechanical system. The sealing member 44 is also constructed to absorb the fluid generated load and to provide a fluid tight joint with the seat 34. In particular, the configuration of the neck 58 eliminates significant stress risers and provides the strength necessary to resist the hydraulic load applied. The step surface 56 of the counterbore 52 being located between the surface 68 of the radial flange portion 66 and the first end 46 of the sealing member 44 places the step surface 56 at a location of maximum material thickness and increased resistance to fatigue loads. These thick sections 70 and 58 allow the clamping loads that are transmitted down through the assembly clamp 114 to be redistributed away from the thin tube section 30. The seat engaging surface 50 being conical and engagable with the spherical surface of the seat 34 provides line contact and a tight leak proof joint when the clamping flange 76 is applying a desired amount of sealing force thereto. Since the seat engaging surface 50 is in an area of maximum crossectional thickness of the sealing member 44, the potential for cracking and leakage is substantially reduced.

The preselected length of the counterbore 52 disposed in the neck 58 of the sealing member 44 is sufficient to enable the first end portion 30 of the tubular conduit 28 disposed therein to be brazed by an appropriate brazing material to the sealing member 44. The step surface 56 establishes a stop for the first end portion 30 of the tubular conduit 28 and controls the position of the first end portion 30 in the counterbore 52 so that an adequate braze length is provided. As a result a load and leak resistant joint is provided.

The central through aperture 78 of the clamping flange 76 being a predetermined amount greater in diameter that the crossectional diameter of the neck 58 at the largest dimension of the neck 58 allows the first and second apertures 82,84 to be easily aligned with apertures in the fuel injector 14 and the first and second slots 72,74 in the sealing member 44. As a result connection of the first end portion 30 of the tubular conduit 28 by way of threaded fasteners 80 is easily achieved.

The second end portion 32 of the tubular conduit 28 is connected to the fluid supplying port 16 of the fluid passing member 18 by way of fitting member 88. This connection is made by way of the threaded outer portion 95 of the fitting member 88 and the threaded portion 108 of the fluid supplying port 16 of the fluid passing member 18. The conical surface 96 of the fitting member 88 is forced into mated engagement with the sleeve member 98 by virtue of a tightening of the fitting member. Similarly, the sleeve member 98 is forced by the fitting member 88 into seating engagement with the flared end portion 86 and the seat 106 disposed in the fluid supplying port 16. By way of this arrangement a fluid tight load resisting connection is provided.

Other aspects, objects and advantages of the present invention can be obtained from a study of the drawings, the disclosure and the appended claims.

We claim:

1. A load absorbing jumper tube assembly for connecting an inlet port of a fuel injector to a fluid supplying port of a fluid passing member of an internal combustion engine and passing fluid flow between the fluid passing member and the fuel injector; comprising:

a tubular conduit having a first end portion, a second end portion and being configured to position the first end portion adjacent the fuel injector inlet port and the second end portion adjacent the fluid passing member fluid supplying port;

a seat having a spherical surface extending from the fuel injector adjacent the inlet port;

a sealing member having first and second opposite ends, a seat engaging surface opening at said first end, a counterbore disposed in the sealing member and opening at said second end, and a bore disposed in said sealing member and opening at said seat engaging surface and into said counterbore, said counterbore and bore being coaxial and defining a step surface therebetween, said tubular conduit first end portion being disposed in the counterbore, engaged with the step surface and connected to the sealing member;

a clamping flange having a central aperture disposed therein and being loosely disposed about the tubular conduit, said clamping flange being engageable with the sealing member and adapted to forcibly urge the seat engaging surface of the sealing member into sealing contacting engagement with the conical surface of the seat.

2. A load absorbing jumper tube assembly, as set forth in claim 1, wherein said sealing member includes a neck having a longitudinal axis, a cylindrical portion adjacent the second end of the sealing member and a tapered portion of increasing diameter located between the cylindrical portion and the second end, said neck having a predetermined length and said counterbore being axially disposed in the neck and extending into the sealing member a predetermined distance greater than the length of the neck.

3. A load absorbing jumper tube assembly, as set forth in claim 2, wherein said sealing member has a radially extending flange, said radially extending flange having a surface and said tapered portion of the neck terminating at the surface of the flange, said tapered portion of the neck having a maximum crossectional diameter at the location of termination of the neck portion at the surface of the flange.

4. A load absorbing jumper tube assembly, as set forth in claim 3 wherein the step surface is located axially between the first end of the sealing member and the surface of the flange portion of the sealing member.

5. A load absorbing jumper tube assembly, as set forth in claim 4, wherein said radially extending flange of the sealing member has a side oriented transverse to the surface of the radially extending flange and first and second spaced slots disposed through said radially extending flange and opening at said side, including, a plurality of threaded fasteners screw threadably connected to said fuel injector and freely disposed in said slots.

6. A load absorbing jumper tube assembly, as set forth in claim 5, wherein said clamping flange has first and second spaced apertures disposed therethrough, said central aperture being located between the first and second apertures and said first and second apertures being aligned with said first and second slots, respectively, said plurality of threaded fasteners forcing said clamping flange into engagement with the surface of the radially extending flange portion.

7. A load absorbing jumper tube assembly, as set forth in claim 2, wherein said seat engaging surface is conical.

8. A load absorbing jumper tube assembly, as set forth in claim 2, wherein the tubular member is connected to the sealing member by a brazing material.

9. A load absorbing jumper tube assembly, as set forth in claim 8, wherein the predetermined length of the neck and the length of the counterbore is sufficient to maintain a leak free braze connection between the tubular conduit and the sealing member.

10. A load absorbing jumper tube assembly, as set forth in claim 8, wherein the second end portion of the tubular conduit has a flared end portion, including;

a fitting member having a bore disposed axially therethrough, first and second spaced ends and a threaded outer portion, said fitting member having a conical surface at the first end of the fitting member, said fitting member bore being open at said conical surface and open at said second fitting end, said tubular conduit second end portion being disposed in the bore of the fitting member;

a sleeve member having first and second conical surfaces and being disposed about the second end portion of the tubular conduit at a location between the flared end portion of the tubular conduit and the conical surface of the fitting;

a fluid passing member seat connected to the fluid passing member and in the fluid supplying port, said fluid supplying port having a threaded portion and said fitting outer threaded portion being screwthreadably connected to the threaded portion of the fluid passing port, said sleeve being forcibly urged by the fitting into engagement with the conical surface of the fitting member and into forcible engagement with the flared portion of the tubular conduit, said flared portion of the tubular conduit being urged by the fitting member into forcible engagement with the fluid passing member seat.

* * * * *